United States Patent [19]

Dola et al.

[11] 4,223,971

[45] Sep. 23, 1980

[54] ELECTRICAL WIRING ASSEMBLY AND METHOD

[75] Inventors: Frank P. Dola, Port Richey; Vincent Nicholas, Brooksville, both of Fla.

[73] Assignee: AMP Incorporated, Harrisburg, Pa.

[21] Appl. No.: 1,127

[22] Filed: Jan. 5, 1979

Related U.S. Application Data

[63] Continuation of Ser. No. 871,866, Jan. 24, 1978, abandoned.

[51] Int. Cl.[3] ..... H01R 13/36

[52] U.S. Cl. ..... 339/95 D

[58] Field of Search ..... 339/95 R, 95 D, 97 R, 339/97 P, 98, 99 R

[56] References Cited

U.S. PATENT DOCUMENTS

| | | | |
|---|---|---|---|
| 2,873,433 | 2/1959 | Despard | 339/95 D |
| 2,952,831 | 9/1960 | Ehrlich | 339/95 D |
| 3,339,170 | 8/1967 | Martin | 339/95 D |
| 3,671,925 | 6/1972 | Drapkin | 339/95 D |
| 3,808,582 | 4/1974 | Aldridge et al. | 339/99 R |

FOREIGN PATENT DOCUMENTS

| | | | |
|---|---|---|---|
| 659316 | 10/1951 | United Kingdom | 339/95 R |

*Primary Examiner*—Joseph H. McGlynn
*Attorney, Agent, or Firm*—Anthony S. Volpe

[57] ABSTRACT

Apparatus and method for terminating conductors such as those used in the wiring in a building are disclosed. A stamped and formed electrical terminal having means for making a solderless termination of an insulated wire is disclosed. In one embodiment this terminal is utilized in a electrical outlet receptacle. The outlet receptacle comprises an insulating housing with terminals for the current carrying and ground wires located therein. A movable insulating member is mounted on the rear of the insulating housing and is adapted to insert the wires into appropriate terminals.

13 Claims, 11 Drawing Figures

ELECTRICAL WIRING ASSEMBLY AND METHOD

This is a continuation of application Ser. No. 871,866 filed Jan. 24, 1978, now abandoned.

BACKGROUND OF THE INVENTION

1. Field of the Invention

This invention is related to the solderless termination of insulated or uninsulated electrical conductors by utilizing slotted plate-like terminals to penetrate the insulation and establish intimate contact with the underlying conductive core. This invention is also related to the installation of various electrical components such as duplex outlet receptacles in the electrical wiring of a building such as a house or mobile home.

2. Description of the Prior Art

Standard electrical wiring devices and fixtures such as outlet receptacles and switches currently used for residential and related electrical wiring generally employ a screw-down wire termination. Installation of these standard prior art devices on standard three wire sheathed non-metallic cables requires several steps. The cable must first be severed. The outer sheath surrounding the two current carrying and the ground wires must be removed. Next the insulation on the end of the hot and neutral conductors must be stripped. The stripped wires are then looped around individual screws which are then tightened in order to secure the wires. The completed assembly together with necessary slack wire must then be stuffed into a standard box mounted within the walls.

A number of modifications to this approach have been suggested. One such modification representative of other approaches is found in U.S. Pat. No. 3,860,739. These duplex receptacles and switches can be mounted by utilizing a hand tool to form the wires in a non-metallic sheathed cable and to insert the wires into slotted plate electrical terminals. The back cover of these receptacles or switches is subsequently mated with the front portion to force the conductors into their respective slotted contacts, automatically penetrating the insulation and making intimate contact between the conductors and the receptacle and switch contact. The cover locks in place maintaining the electrical and mechanical integrity of the connection.

Another principle that can be utilized to terminate electrical conductors in an electrical wiring assembly is illustrated by U.S. Pat. No. 3,489,985. Duplex receptacles employing this concept utilized poke-in type terminals. These poke-in terminals require stripping the insulation from the ends of the individual conductors prior to termination. Spring-type wire fastening means are employed to grip conductors which have been inserted between the spring members and an appropriate backup surface. The spring is flexed or cammed by the entry of the stripped conductors and one edge of the spring establishes an electrical contact with the inserted wire.

Numerous slotted members have been proposed for solderless termination of insulated or uninsulated electrical conductors. In addition to the solderless termination means employed in the previously described prior art, stamped and formed terminals having a central segment removed to define a slot with opposed wire gripping edges and the plane of the terminal have been widely used. Another slotted plate type termination of interest is shown in U.S. Pat. No. 3,162,501. In this patent lances have been struck from opposite sidewalls of a U-shaped plate-like member. As an insulated conductor is inserted into the U-shaped member these inwardly deflected lances penetrate the insulation and establish intimate contact with the underlying conductive core.

SUMMARY OF THE INVENTION

A stamped and formed electrical contact terminal as disclosed and claimed herein comprises a plate-like member having integral longitudinal wire terminating members to establish electrical and mechanical contact with a wire upon movement of the wire laterally of its local axis into the termination member. The plate-like member also employs integral stiffening means which limit the lateral deformation of the terminal member due to insertion of a wire into the wire terminating members. A plurality of wire terminating members may be longitudinally positioned in a plate-like member and can consist of diagonally extended flange members having oppositely facing edges defining a wire termination slot. These stamped and formed terminals can be effectively used to terminate wires in a modified duplex outlet receptacle or in other electrical wiring fixtures such as switches. The terminals can be mounted in an insulating housing with the wire terminating members disposed along the rear of the insulating housing. Movable insertion members can be mounted on the rear face of the wiring fixtures. Individual wires can be inserted through holes provided in movable insertion members and into position for terminating within the plate-like terminals. Lateral movement of the insertion members imparted by a wedge member, such as a screwdriver, forces the wires into termination members such as the previously described slotted contacts.

The invention as disclosed and claimed herein is intended to satisfy the following objectives and restrictions.

Electrical contact should be established without individually stripping individual wires.

Intimate contact with the electrical conductors is to be established by locally plastically deforming the conductors with a resilient contact member to form a secure electrical and mechanical connection. By engaging each wire on opposite sides, a redundant contact is formed.

Significant tensile forces tending to damage the mechanical and electrical termination must be resisted.

Termination of two current carrying and one ground wire should be simultaneously established. Up to four incoming cables must be terminated to appropriate terminals in either a duplex outlet or a switch having the same volume as standard electrical wiring elements. Either a through wire or an end of the line configuration must be provided.

A reduction in labor involved in making a termination to standard electrical wiring fixtures and a minimization in the slack or waste cable is required.

The solderless termination of insulated wires to an electrical wiring fixture such as a duplex outlet or switch must be accomplished without the need for specialized tools.

DETAILED DESCRIPTION OF THE INVENTION

Figure 1:
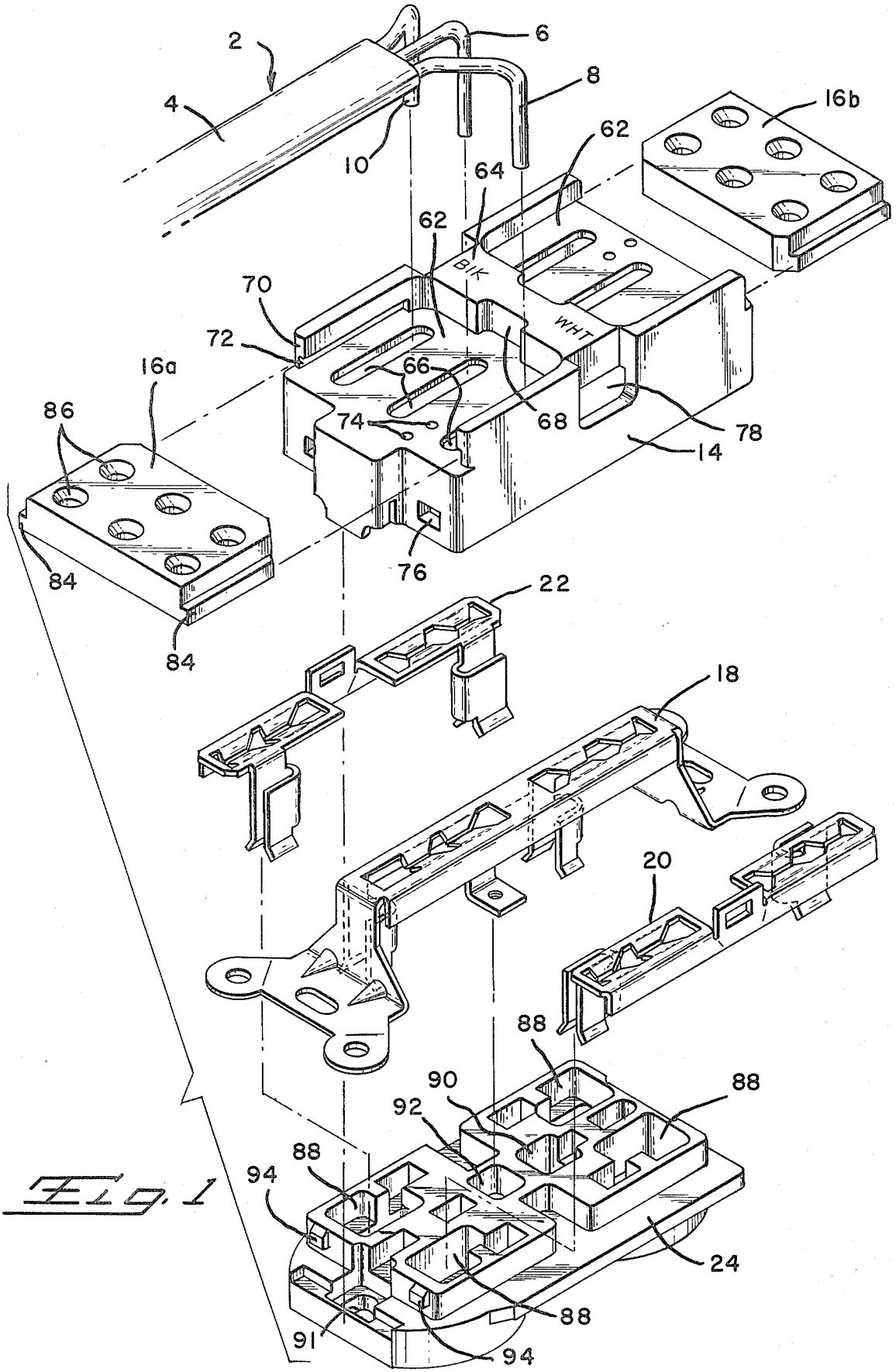
FIG. 1 is an exploded perspective showing the components of the preferred embodiment of a duplex outlet receptacle.
Figure 2:
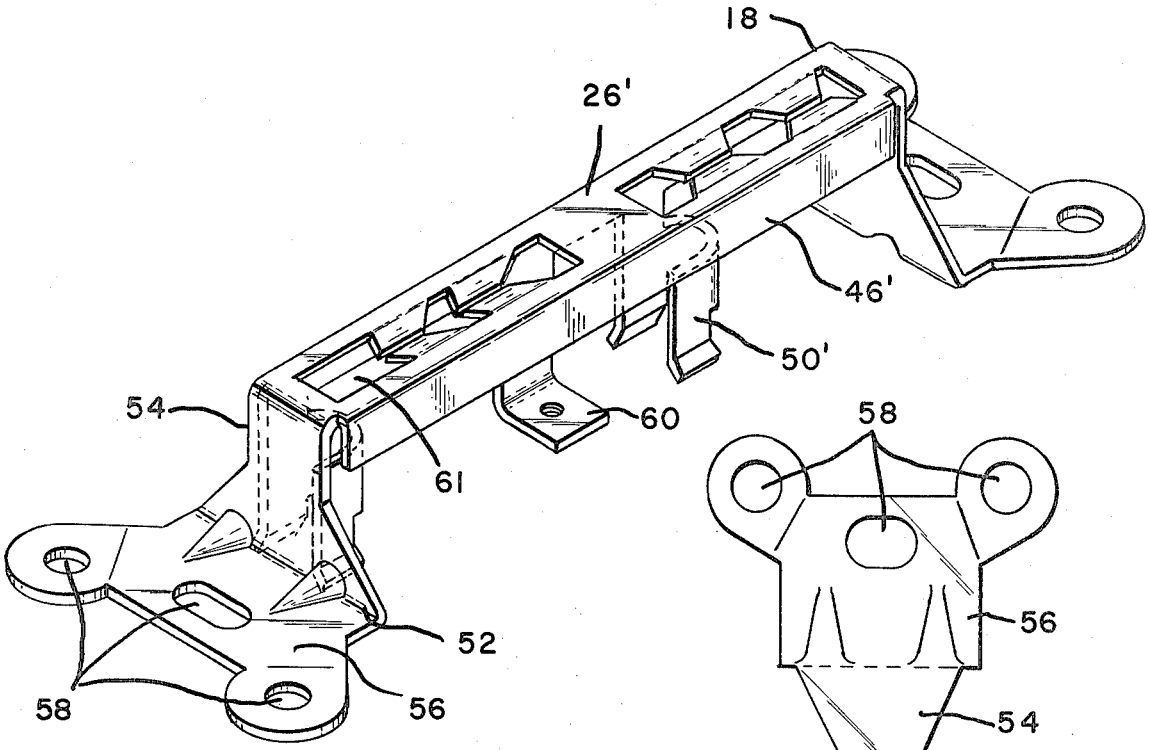
FIG. 2 is a perspective view of a ground wire terminal.
Figure 3:
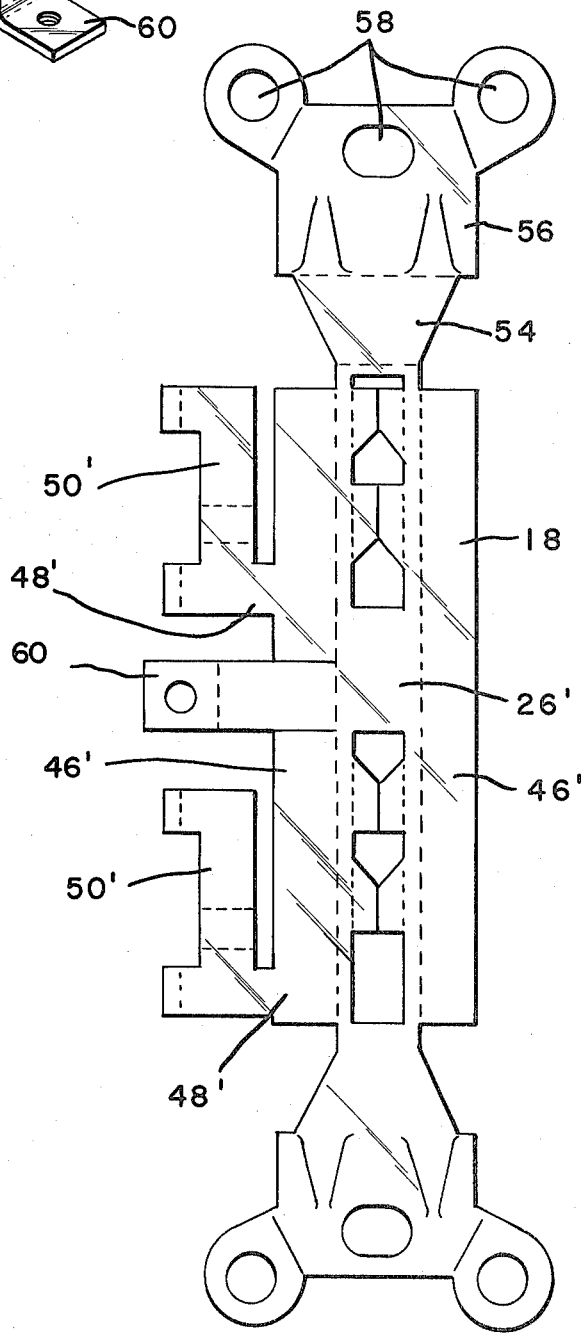
FIG. 3 is a view of a blank used to form the terminal of FIG. 2.
Figure 4:
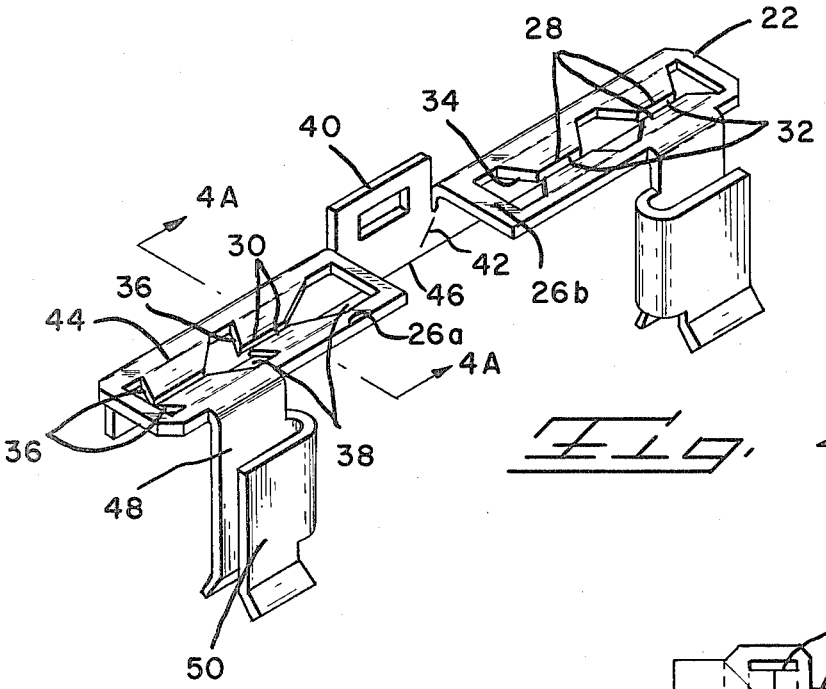
FIG. 4 is a view of a terminal used for a hot or neutral individually insulated wire.
Figure 4A:
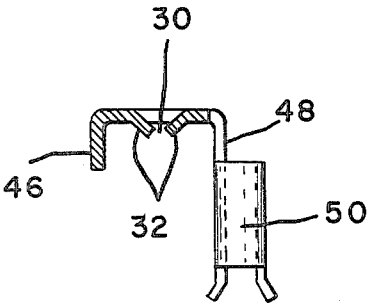
FIG. 4A is a cross-section of the terminal shown in FIG. 4.
Figure 5:
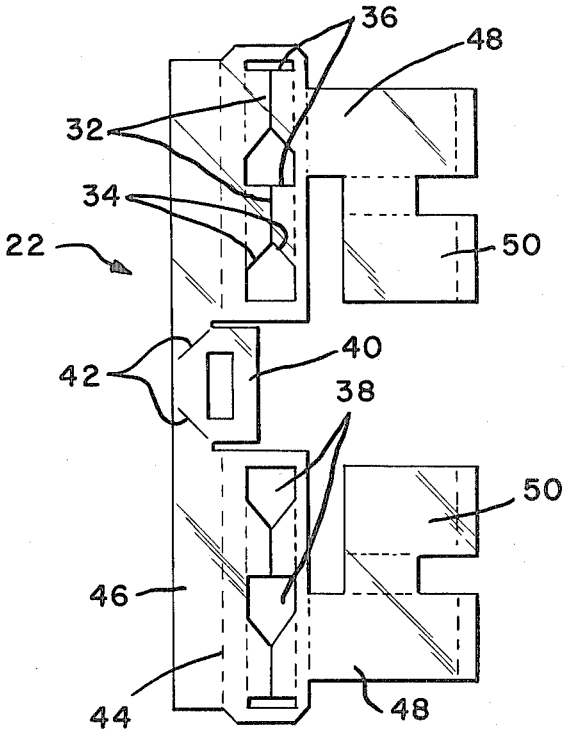
FIG. 5 is a view of a blank used to form the terminal of FIG. 4.

The preferred embodiment of this invention is adapted to terminate the wires in a three wire non-metallic sheathed cable of the type generally used for indoor wiring. These non-metallic sheathed cables 2 have an outer plastic insulating sheath for surrounding three conductors. These conductors are generally 12 or 14 gauge wire. AWG 14 wire has a diameter of 0.064 in. (0.163 cm.). An uninsulated ground conductor 6 is located between an individually insulated neutral or white wire 8 and an individually insulated hot or black wire 10. The preferred embodiment of this invention comprises a duplex outlet receptacle 12 which can be attached to non-metallic sheath cable 2. It should be understood, however, that this invention can be used to attach other wiring fixtures to any of a number of types of electrical cables. For instance, this invention could be easily used with a standard wall switch. While this invention is specifically adapted to electrical wiring assemblies the invention is not limited to use in house wiring systems. This invention can easily be used to terminate other types of insulated or uninsulated electrical conductors, and is especially adapted to terminating relatively large conductors such as AWG 12 or 14 gauge.

As shown specifically in FIG. 1 the duplex outlet receptacle 12 comprises two matable housing components 14 and 24. These outer housing components contain three stamped and formed contact terminals 18, 20 and 22 in suitable interior compartments. Terminals 18, 20 and 22 can be stamped and formed using a electrically conductive metal having spring-like properties. Brass terminals are used in the preferred embodiment. A pair of slidable insulating insertion members or doors 16A and 16B are mounted on the rear face of insulating base 14. These insertion members 16 are intended for use in bringing about a good electrical termination to either individually insulated wires such as 8 and 10 or to uninsulated wires such as 6.

A separate terminal is used to terminate each of the three wires 6, 8 and 10 in non-metallic sheathed cable 2. A neutral wire terminal 20 and a hot wire terminal 22 flank a central ground wire terminal 18. Terminals 20 and 22 are duplicates. Ground wire terminal 18 employs the same basic wire termination concept and differs somewhat from terminals 20 and 22. A description of the structure of 22 will, however, be sufficient to set forth the basic wire termination concept used in each of the three terminals. The structure of terminal 22 will be described in detail and it should be understood that those differences exhibited by ground wire terminal 18 will be described in a separate description of that terminal.

Terminal 22 comprises two adjacent first plate-like segments 26A and 26B located in the same plane. Each plate-like segment 26 contains two wire contact slot means 32. Wire contact slot means 32 are defined by oppositely facing slot edges 30. Slot edges 30 in turn comprise the interior edges of oppositely facing inner slot flanges 28. Inner flanges 28 are formed by initially shearing first plate-like segments 26 along a longitudinal axis. The material between bend axis 44 and slot edge 30 is then formed so that inner flanges 28 extend diagonally with respect to first plate-like segments 26A and B. Each plate-like segment 26 contains two aligned slot means 32 and terminal 22 contains four collinear slots 32. Longitudinal slot edges 30 are parallel to bend axis 44. A first diagonal wire entry transverse edge extends from each slot edge 30 to bend axis 44. A second transverse edge 36 extends from the opposite edge of each slot 30 to bend axis 44. Second transverse edge 36 is perpendicular to both bend axis 44 and slot edge 30. An enlarged wire entry port 38 is defined in part by first diagonal transverse edges 34. One wire entry port is located adjacent to each wire contact slot means 32. An outer stiffening flange 46 extends longitudinally from one end of terminal 22 to the other end. In terminal 22 a longitudinal stiffening flange 46 extends along only one side of the terminal. Stiffening flange 46 extends beside and beyond all of the slot means 32. The central portion of stiffening flange 46 between first plate-like segments 26A and B in terminal 22 comprises a break-off tab 40. A pair of break-off crease lines 42 extend below tab 40 to the lower edge of flange 46. These crease lines 42 comprise a weakened section of terminal 22. Two plug engaging elements 48 extend from the opposite side of terminal 22. One plug engaging element 48 is associated with each plate-like segment 26A or B. Element 48 has a frictional plug contact element comprising a generally U-shaped member located adjacent the free end. Contact element 50 defines a vertically extending void between oppositely facing sidewalls of the U-shaped element 50, and is dimensioned to receive a standard electrical plug element.

Ground terminal 18 has four aligned slot means 32 similar to the slot means of terminal 22. The first plate-like segment of terminal 18 extends continuously from one end of the terminal to the other. Outer stiffening flanges 46 similar to the same flange in 22 extend from both lateral edges of ground plug first segment 26. Plug engaging elements similar to elements 48 shown in terminal 22 extend from one edge of ground plug 18. Ground plug 18 also has a central mounting tab extending from one outer flange. Mounting tab 60 contains a hole and can be secured to an outer cover plate which is not shown. Receptacle mounting brackets 52 are located at opposite ends of ground terminal 18. Bracket 52 comprises an intermediate bracket leg 54 extending perpendicular to first segment 26 and a bracket flange 56 extending parallel to and spaced from plate 26. Bracket flange 56 has three mounting holes 58 positioned to accept screws which can be used to mount the entire receptacle 12 on standard mounting fixtures.

Figure 6:
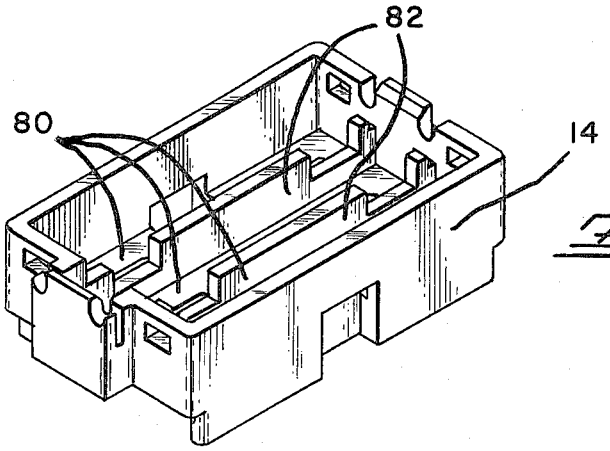
FIG. 6 is a view of the interior of the insulating base.

Terminals 18, 20 and 22 can be mounted on the interior of matable housing parts 14 and 24. These terminals are mounted in three separate compartments 80 defined on the interior of the base 14 and cover 24, as best illustrated in FIG. 1 and in FIG. 6 showing the interior of insulating base 14. Cover member 24 has four pockets 88 located at each corner. These pockets are dimensioned to partially receive the plug engaging elements 48 of terminals 20 and 22. Slightly different pockets 90 and 91 are dimensioned to receive the plug engaging elements of ground terminal 18. A centrally located pocket 92 having a hole for receiving a cover plate screw, which is not shown, is intended to receive central mounting tab 60. The three compartments 80 receiving the three terminals are further defined by the interior structure of insulating base 14. Base 14 has two londitudinal ribs 82 extending from opposite ends defining portions of compartments 80. When insulating cover 24 is mated with insulating base 14 and locked by detents 94 and sockets 76 the individual terminals are securely retained within their separate compartments 80. Openings 78 are provided near the center of each sidewall of housing 14. These openings 78 receive break-off tabs 40 making tabs 40 accessible from the exterior of a fully assembled receptacle housing.

The exterior surface of base 14 has integral laterally extending central ridge 64 located between openings 78. Rear planar surfaces 62 extend on either side of central ridge 64. A central recess 68 is located on either side of central ridge 64 adjacent the inner edge of face 62. Three longitudinally extending wire access cavities 66 extend from interior compartments 80 through to face 62. Two longitudinally extending ridges or side rails 70 extend along opposite sides of each planar surface 62. Each side rail 70 also defines a longitudinally extending groove 72 adjacent surfaces 62. Two bumps 74 are located adjacent the end of each surface 62. Bumps 74 are aligned longitudinally. When base 14 is mated with cover 24, gripping members 94 engage openings 76 to interlock the two outer housing components.

Two slidable insulating insertion members 16A and B are dimensioned for receipt on adjacent rear surfaces 62. Insertion members 16A and 16B are molded of an insulating material and each has two rows of three aligned holes 86 extended between opposite spaces. A shoulder 84 extends along each side edge of each insertion member 16. Shoulder 84 is dimensioned to be received by longitudinal groove 72. Members 16A are slidable along surface 62 between sidewalls 70. Each member 16 can be inserted along surface 62 until the inner edge is flush with the sidewalls of central ridge 64 leaving only recess 68. Bumps 74 engage appropriate concave sufaces on the lower side of members 16 and define two positions for insertion member 16. The first open position of member 16 is one in which the inner edge is flush with the side of central ridge 64. In the second terminated position, the inner edge of insertion member 16 is spaced a short distance from this side of ridge 64.

Figure 7:
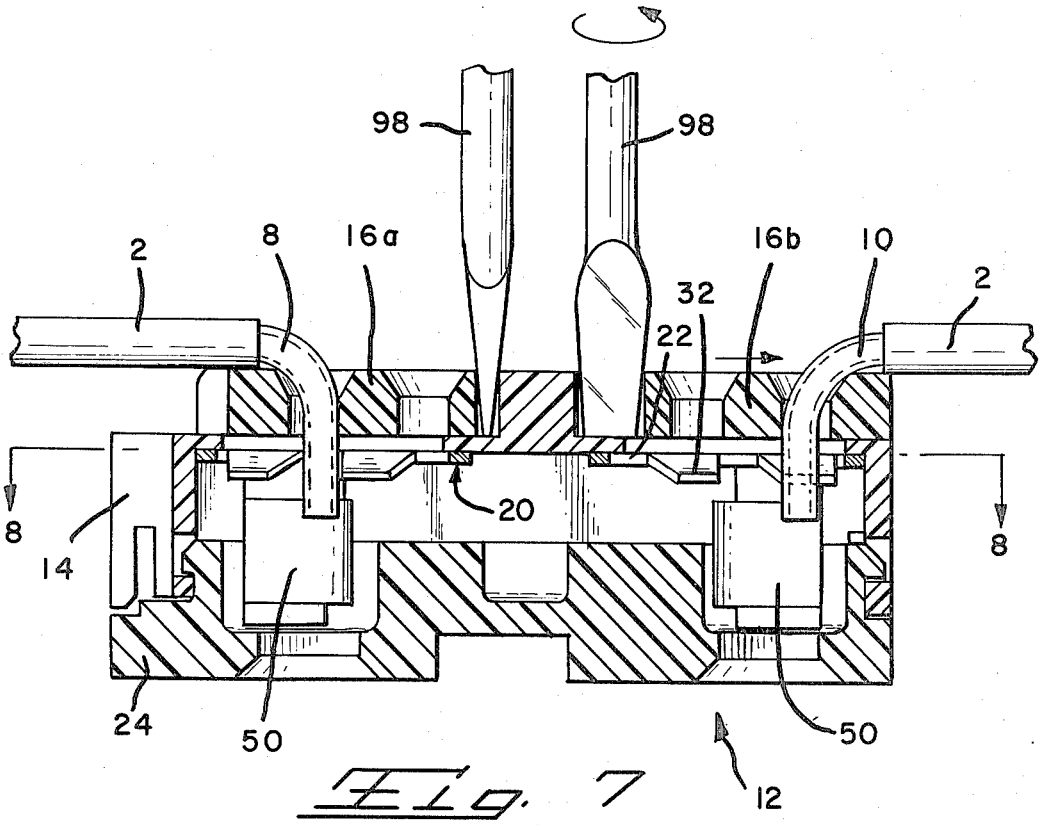
FIG. 7 is a section view illustrating the solderless termination of wires in a non-metallic sheathed cable.
Figure 8:
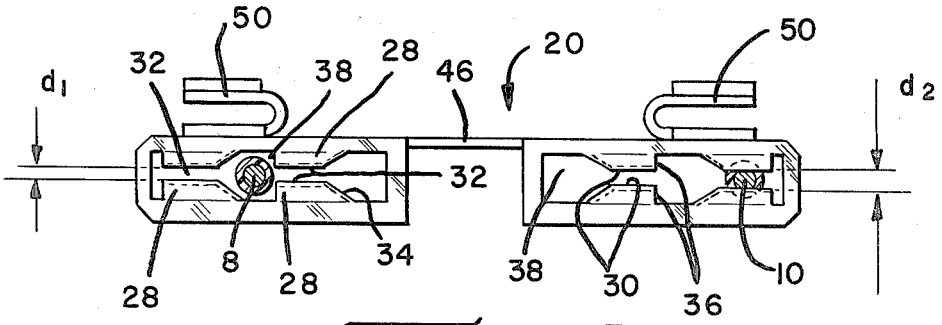
FIG. 8 is a view illustrating the termination of wires and represents the wires as shown in FIG. 7.

Up to four non-metallic sheath cables 2 can be easily attached to a single duplex receptacle 12. The outer plastic sheath 4 of cable 2 must first be stripped away from the end of cable 2. Any filler material contained in cable 2 must also be removed to completely expose the ends of wires 6, 8 and 10. Advantageously wires 6, 8 and 10 are bent near one end. The ends of the wires are then inserted through aligned holes 86 of a insertion member 16 located in the initial open position. A wedge member 98 such as a standard screwdriver can then be inserted into recess 68. Wedge member 98 then serves as a lever or as a cam to force insertion member 16 from its open to the closed terminated position. FIG. 7 illustrates the two positions of insertion members 16 and shows a wedge member 98 prying insertion member 16 from the first to the second position. FIG. 8 is a schematic showing the actual mechanical and electrical termination formed for each wire. The inner flanges 28 of terminals 18, 20 and 22 comprise resilient spring members. As each wire is forced into the appropriate slot 32 the insulation is penetrated along first transverse edges 34 and along slot edges 30. During termination of each conductor the inner slot flanges elastically deform and change in width occurs. A slot 32 having no wire has a width equal to $d_1$ when a wire is inserted into a slot 32 the width of the slot is slightly larger and is represented by $d_2$. While inner flanges 28 are elastically deformed by wire insertion, the conductive core of the wires is plastically deformed and contaminants such as insulating oxides are removed. In this way a secure and reliable long term electrical and mechanical connection is formed between the resilient slot edges 30 of the stamped and formed terminals shown and the conductive core insulated or uninsulated wires. Note that flanges 28 extend inwardly relative to the rear face of housing 14. This serves to increase the resistance to a tensile force on the wires, thus increasing the mechanical integrity of the connection. The resilient terminals employed in this preferred embodiment permit termination of wires by exertion of a relatively low insertion force.

Figure 9:
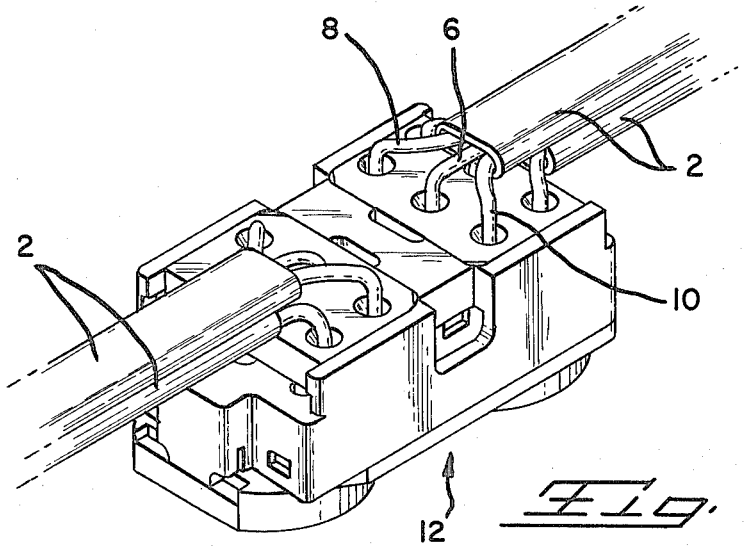
FIG. 9 shows four cables extending into the rear of a receptacle immediately prior to termination.
Figure 10:
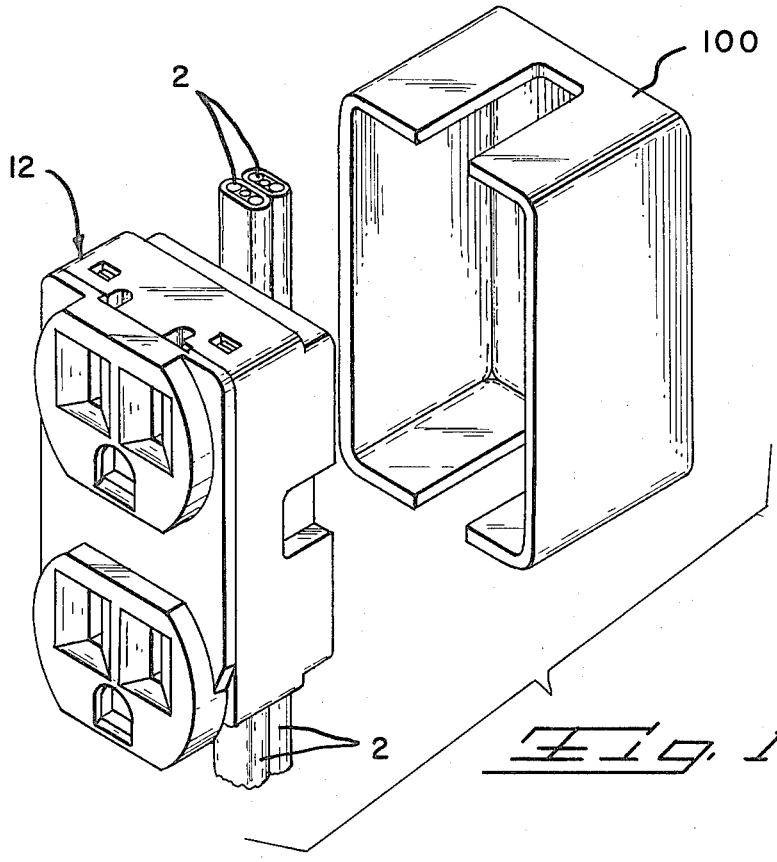
FIG. 10 shows a frontal view of the preferred embodiment of a duplex receptacle and a cover member.

FIGS. 9 and 10 illustrate the orientation of four cables which can be attached to duplex receptacle outlet 12. A minimum of slack cable is required for this installation and receptacle can be easily inserted into either a standard outlet box or an insulating cover 100 as shown in FIG. 10.

What is claimed is:

1. An electrical connector for establishing an electrical termination to a relatively stiff copper wire, such as a wire having a diameter on the order of 0.064 in. (0.163 cm.), comprising a stamped and formed contact terminal having a wire termination slot defined by edges of resilient, longitudinally extending flange members, integral with said stamped and formed terminal, said resilient flange members being flexible only about an axis parallel to said edges, said edges gripping the wire so that an axial tensile force on the wire in one direction will tend to flex said members so as to reduce the width of said slot and to increase resistance to the tensile force, a dielectric housing dimensioned to receive said contact terminal and an insertion member matable with said housing and movable longitudinally parallel to and in alignment with said slot for engaging said wire at a point spaced from said slot and moving said wire perpendicular to its length into said slot so that an electrical contact is established between said wire and said edges.

2. An electrical outlet receptacle for use with three-wire non-metallic sheathed cable in electric power installations, said outlet receptacle comprising:

a) insulating housing means further comprising:

i) a first housing member having a front face adapted to receive a standard three prong electrical plug therein, ii) a second housing member matable with said first housing member, said first and second housing members defining three longitudinal terminal receiving compartments, said second housing member having three longitudinal open-ended cavities on the rear face, each cavity merging with a terminal receiving compartment, (b) integral stamped and formed contact terminals in each compartment, said terminals each further comprising:

(i) a plate-like segment extending parallel to said rear face, (ii) contact means on said plate-like segment for establishing electrical contact with a wire upon movement of the wire perpendicularly of its length into said contact means, (iii) contact means extending from said plate-like segment for frictionally receiving a prong on an electrical plug, and (c) slidable insertion means mounted on the rear face of the second housing member, said slidable insertion means having a wire receiving hole aligned with each open-ended cavity, each hole dimensioned for receipt of one wire, whereby each wire in said three-wire cable can be placed in a hole in said slidable insertion means and an electrical and mechanical connection is established between the wire and the respective terminal contact means by movement of said slidable insertion means.

3. An electrical outlet receptacle comprising:

an insulating housing having a plurality of apertures located on the front face thereof, said apertures dimensioned to permit entry of the electrical contacts of a standard electrical plug, a plurality of contact terminals equal in number to said apertures and located in said housing, said terminals further comprising:

an elongated plate-like segment extending generally parallel to and spaced from said front face, a slot extending longitudinally in said plate-like segment, said slot having independent opposed edges for engaging a wire as said wire is moved perpendicularly of its length into said slot, depending means for frictionally receiving said electrical contact entering said housing, said depending means extending generally perpendicular to said plate-like segment toward and in alignment with said apertures, and insertion means matable with the rear of said insulating housing, located adjacent said plate-like segment in alignment with said slots in said terminals and movable parallel to said slots to transfer a wire perpendicularly of its length into a respective slot among said slots thereby forming a mechanical and electrical connection.

4. An electrical outlet receptacle as set forth in claim 3 wherein the portion of said plate-like segment immediately adjacent to and terminating in said opposed edges is bent relative to the plane of said plate-like member.

5. An electrical outlet receptacle as set forth in claim 4 wherein said slot further comprises a wire entry portion having a width generally greater than the spacing between said opposite slot edges.

6. An electrical outlet receptacle as set forth in claim 5 wherein said slot edges are located between the plane of said plate-like segment and said front face.

7. An electrical outlet receptacle as set forth in claim 6 wherein said plate-like segment and said depending means comprise integral portions of a single stamped and formed resilient metal strip.

8. An electrical outlet receptacle as set forth in claim 3 wherein said plurality of apertures on the front face thereof comprise a standard outlet socket.

9. An electrical outlet receptacle as set forth in claim 8 wherein said insertion means comprises an insulating member having an opening therethrough in alignment with each said slot for receiving a wire therethrough.

10. An electrical outlet receptacle as set forth in claim 9 further comprising two substantially identical source conductor contact terminals generally parallel to and on opposite sides of a third central ground contact terminal, each terminal having a slotted plate-like segment.

11. An electrical outlet receptacle as set forth in claim 10 wherein said electrical outlet comprises a duplex receptacle.

12. An electrical outlet receptacle as set forth in claim 11 wherein each terminal includes a plurality of collinear slots, each slot for establishing electrical and mechanical connection with one wire.

13. An electrical outlet receptacle as set forth in claim 11 further comprising two insertion means, one insertion means corresponding to each receptacle, said plural insertion means each being movable in the same plane relatively away from the other insertion means to transfer wires into corresponding slots.

* * * * *